United States Patent [19]

Gregory

[11] Patent Number: 5,054,627

[45] Date of Patent: Oct. 8, 1991

[54] DISPLAY DEVICE FOR MERCHANDISING NUTS AND BOLTS

[76] Inventor: Frederic M. Gregory, 4322 Lakewood Blvd., Long Beach, Calif. 90808

[21] Appl. No.: 586,698

[22] Filed: Sep. 24, 1990

[51] Int. Cl.[5] ..... A47F 5/00

[52] U.S. Cl. ..... 211/94; 211/13; 211/94.5; 206/338

[58] Field of Search ..... 211/94, 94.5, 13, 60.1, 211/193, 59.2; 206/338

[56] References Cited

U.S. PATENT DOCUMENTS

| | | | |
|---|---|---|---|
| 1,633,154 | 6/1927 | Yamakishi | 211/59.2 X |
| 2,269,310 | 1/1942 | Hollander | 211/94 |
| 2,813,634 | 11/1957 | Andersson | 211/94 |
| 3,298,763 | 1/1967 | Di Domenico | 211/59.2 X |
| 3,321,074 | 5/1967 | Marsh | 206/338 |
| 4,151,912 | 5/1979 | Harrold | 206/338 |
| 4,744,489 | 5/1988 | Binder et al. | 211/59.2 X |
| 4,821,877 | 4/1989 | Aab et al. | 206/338 |
| 4,928,913 | 5/1990 | Laughon et al. | 211/94 X |

*Primary Examiner*—Robert W. Gibson, Jr.
*Attorney, Agent, or Firm*—Frederick Gotha

[57] ABSTRACT

A cantilever display device for merchandising and storing nuts and bolts which has a first side-wall member and a second side-wall member that slideably engage each other at the mounting end of the device and have axially extending lower flange members projecting transversely toward each other from each of said side-wall members such that an axial extending lower slot is defined by the axially extending lower flanges. A plurality of cylindrically shaped internally threaded receptacles extend laterally from the first side-wall member to receive securing bolts which fasten the second side-wall member to the first side-wall member. By adjusting the securing bolts, the lower slot width is adjustable thereby permitting a pre-selected shank diameter of a bolt to extend through the lower slot while the bottom face of the bolt head bears against the lower flanges. A U-shaped reinforcing rib member is removably mountable and can be provided in different width sizes which may be selected for insertion into the display device for a desired lower slot width.

5 Claims, 5 Drawing Sheets

6
8
11
17
16
18
14
13
9
44
17'
16'
14'
13'
21
7
19
32
29
33
34
31

17
16
18
14
13
22
13'
14'
19
16'
17'
6
7
8
9
42
44

DISPLAY DEVICE FOR MERCHANDISING NUTS AND BOLTS

FIELD OF THE INVENTION

This invention relates to a display device for merchandising and storing nuts and bolts.

BACKGROUND OF THE INVENTION

In the merchandising of nuts and bolts, it is common to find various size bolts and nuts loosely displayed in bins which are bulky and unappealing in presentation of product. These bins are directly accessible to the consumer who, during the process of selection of the product, often returns the product to the wrong bin thereby causing an intermingling of various sizes of nuts and bolts. A subsequent purchaser therefore may have difficulty in locating and being assured that the nut or bolt selected is consistent with the designated sizes identified with each bin. In other forms of product presentation it is desirable to display the product at eye level in transparent containers such as plastic bags or transparent containers. The bags and containers are generally suspended from hooks at or below eye level from peg boards. This method of merchandising is generally limited to small sizes of nuts and bolts and each package has a fixed number or quantity of nuts and bolts. Thus, only pluralities of fasteners are available for purchase. The purchaser under these circumstances must purchase a greater number of nuts and bolts than he needs.

The interminglying of bolts and nuts of various sizes also commonly occurs in the storage or inventory of these items by machine shops, repair garages, and individual storage facilities. Fasteners of particular sizes are generally unsegregated and comingled requiring the user to rummage through his inventory to find the appropriate nut or bolt for a specific application.

SUMMARY OF THE INVENTION

There is, therefore, provided according to the present invention, an improved merchandising and display device for nuts and bolts which is adjustable in width so as to accommodate different sizes of nuts and bolts and is readily attachable to a track rail so that the product can be displayed at eye level or any other desired level. A multiplicity of devices can be mounted adjacent to each other to offer a wide selection of sizes and permit the purchaser to buy product in accordance with his needs. The device may also be used as a storage device in the same manner.

The present invention is directed to an apparatus which is comprised of a first side-wall member and a second side-wall member which slideably engage each other at their mounting ends and have an axially extending lower flange member projecting transversely from each side-wall member such that an axial extending lower slot is formed at the bottom of the apparatus. A plurality of cylindrically shaped internally threaded receptacles extend laterally from a first side-wall member to receive a multiplicity of securing bolts which extend through aligned aperatures located in the adjoining second side-wall member. The transverse width between the side-wall members may be adjusted by tightening the securing bolts such that the lower slot width is adjustable to permit the shank of the bolt to extend through the slot while the bottom face of the bolt head bears against the lower flanges. A U-shaped reinforcing rib member is removably insertable into the display device at its cantilever end and has a base flange which bears against a base surface formed by the transversly extending middle flanges of the side-wall members; the rib member also has a nut support flange which bears against the surface formed by mezzanine flanges extending transversly from each side-wall member respectively. This structural arrangement permits a plurality of bolts to be removably carried by the display device (and readily visible to a prospective purchaser) and easily removable by merely sliding the bolt in the axial direction of the lower slot. The reinforcing rib member is available in different width sizes for variously dimensioned bolts and a particular reinforcing rib member is selected for insertion into the display device for a desired lower slot width.

The invention also provides for a linear display of nuts which are visible to the purchaser or storage user through an axially extending slot in the upper surface of the joined side-wall members. To remove a nut it is merely necessary to slide the nut along a support surface which is located below the upper slot defined by the space between the upper flanges of the assembled side-wall members.

The display apparatus extends in cantilever fashion from a mounting rail that is attached to a support platform such as a peg board. The rail is so adapted that the display apparatus at its mounting end can be attached to the rail which then forms a support for the cantilever extension of the display device.

It is an object of the present invention therefore to provide a display device for merchandising nuts and bolts which can be adapted by selectively changing its width to carry variously dimensioned nuts and bolts in a pleasing display at or below eye level. The display devices have a mounting end which can be attached to a rail member such that a plurality of display devices can be mounted to offer different sizes of product.

It is a further object of the present invention to provide a display device for the storage or inventory of nuts and bolts.

BRIEF DESCRIPTION OF THE DRAWINGS

These and other features and advantages will become appreciated as the same become better understood with reference to the following specification, claims and drawings wherein:

DETAILED DESCRIPTION

Figure 1:
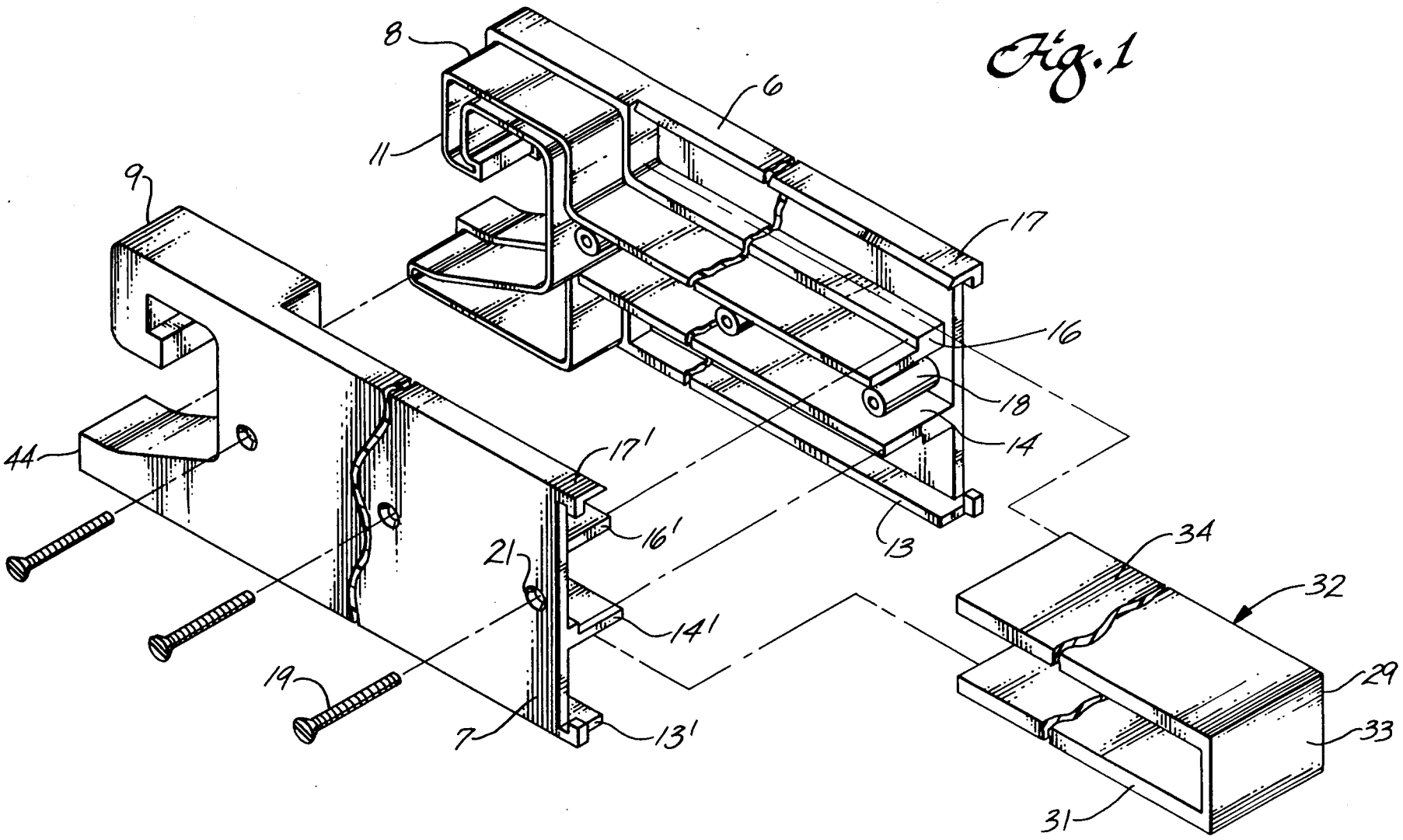
FIG. 1 is an exploded perspective view of the display device.
Figure 1A:
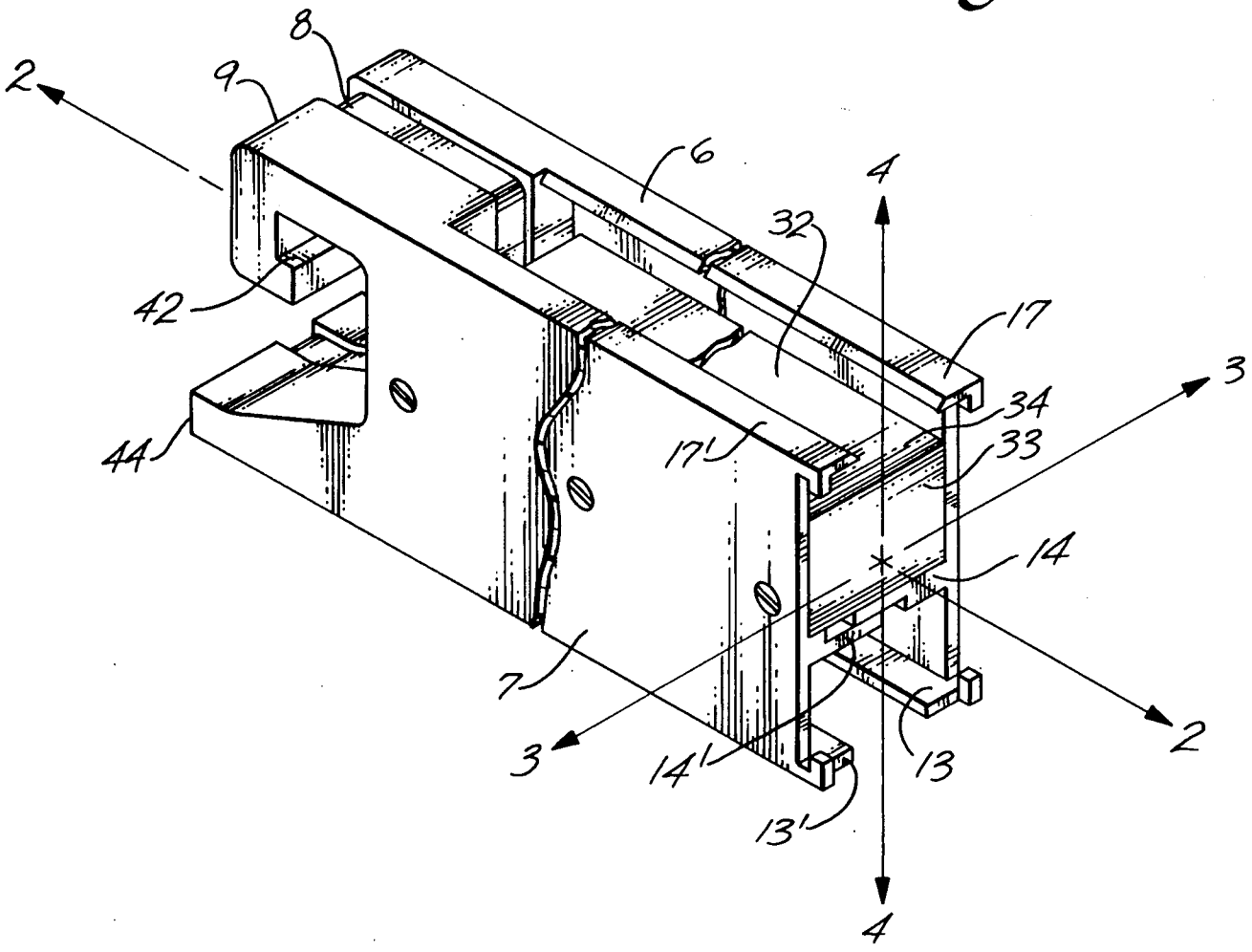
FIG. 1A is a perspective view of an assembly of the structural members shown in FIG. 1.

Referring to FIG. 1A, an assembly is illustrated of the display device having a longitudinal axis 2, a transverse axis 3 and a vertical axis 4. As can be seen in the exploded perspective view of FIG. 1, the display device is comprised of a first side-wall member 6 which sideably engages second side-wall member 7 at the mounting ends 8 and 9 respectively of the side-wall members. The slideable engagement is provided by a transversely projecting series of plane surfaces at mounting end 8 which form an inverted G-shaped extension or mating surface that is slideably received in receiving slot 12 (shown more clearly in FIG. 4) contained in mounting end 9.

Referring again to FIG. 1, first side-wall member 6 has a lower longitudinally extending flange 13, a middle longitudinally extending flange 14 and a mezzanine flange 16 which extends axially in the direction of longitudinal axis 2. Similarly, second side-wall member 7 has a lower flange 13', a middle flange 14' and a mezzanine flange 16' where all of said flanges extend transversely towards each other and also extend longitudinally in the direction of longitudinal axis 2. Upper flanges 17 and 17' extend transversely towards each other from first side-wall member 6 and second side-wall member 7 respectively and also extend longitudinally in the direction of longitudinal axis 2.

To secure first side-wall member 6 and second side-wall member 7 together, a plurality of transversely projecting internally threaded cylinders 18 are provided on side-wall member 6. A plurality of threaded securing bolts 19 extend through aperatures 21 located in second side-wall member 7 and thread into cylinders 18; by adjusting securing bolts 19 the transverse distance between first side-wall member 6 and second side-wall member 7 is controllable to a desired dimension.

Figure 2:
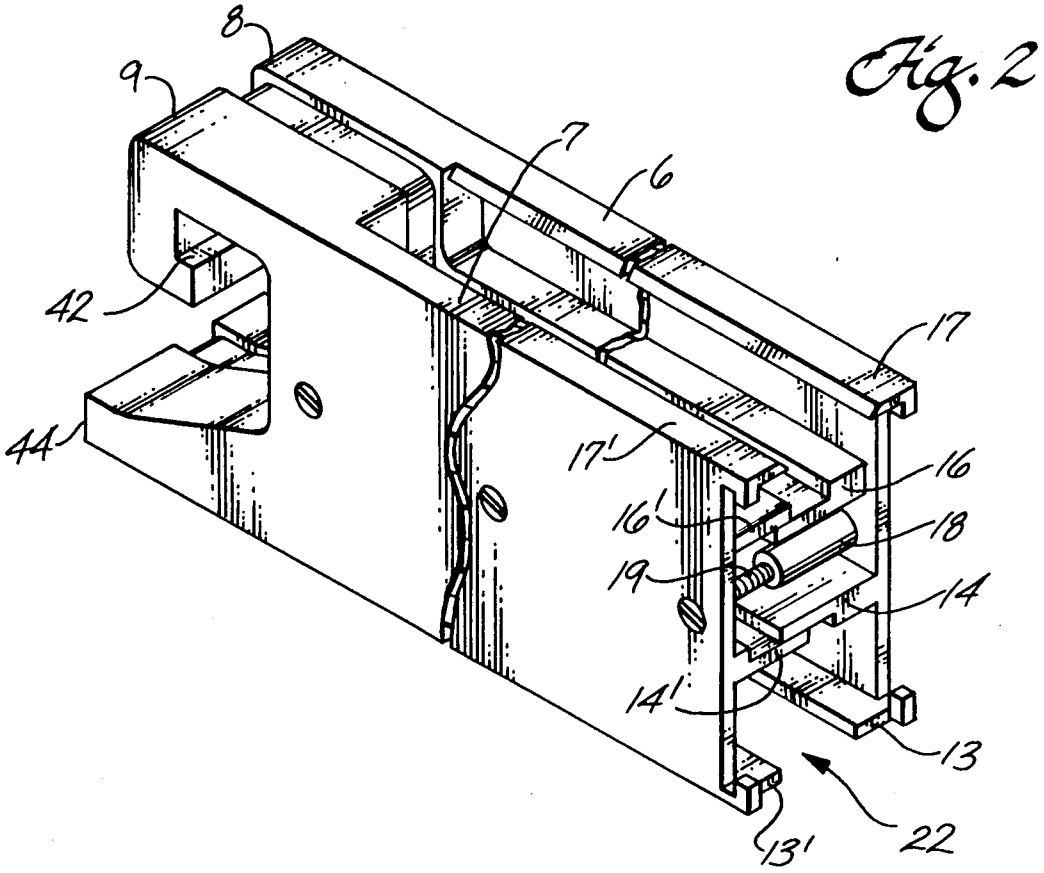
FIG. 2 is a perspective view of an assembly of the structural members shown in FIG. 1 without the reinforcement rib member.

Referring now to FIG. 2, it can be seen that by tightening securing bolts 19 the transverse distance between lower flanges 13 and 13' and the transverse distance between upper flanges 17 and 17' is selectively controllable. Thus, bottom slot 22 formed by lower flanges 13 and 13' may be adjusted to accommodate various dimensions of bolts. By referring to FIG. 6, a plurality of display devices 1 are shown with display bolt 23 supported by lower flanges 13 and 13'. Thus to load the display device with a plurality of bolts 23, the bolts are singularly loaded sequentially by inserting the bolt head 24 into channel 26 such that the shank 27 of bolt 23 extends through bottom slot 22.

Figure 5A:
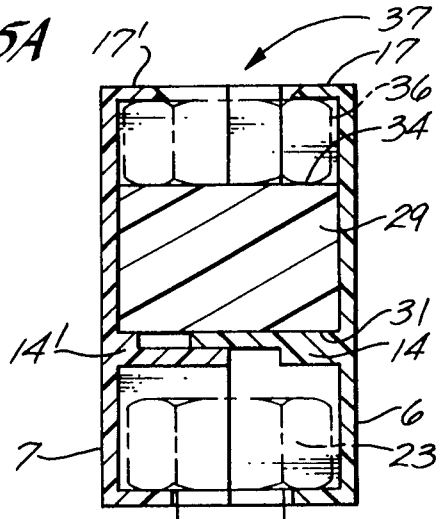
FIG. 5A is a sectional along line 5A—5A.
Figure 5:
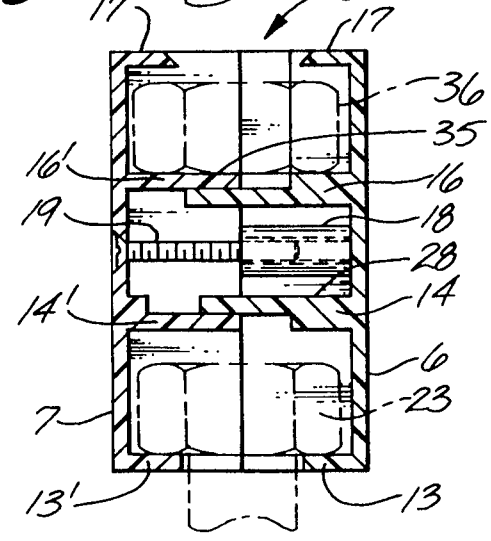
FIG. 5 is a sectional view along the line 5—5.
Figure 3:
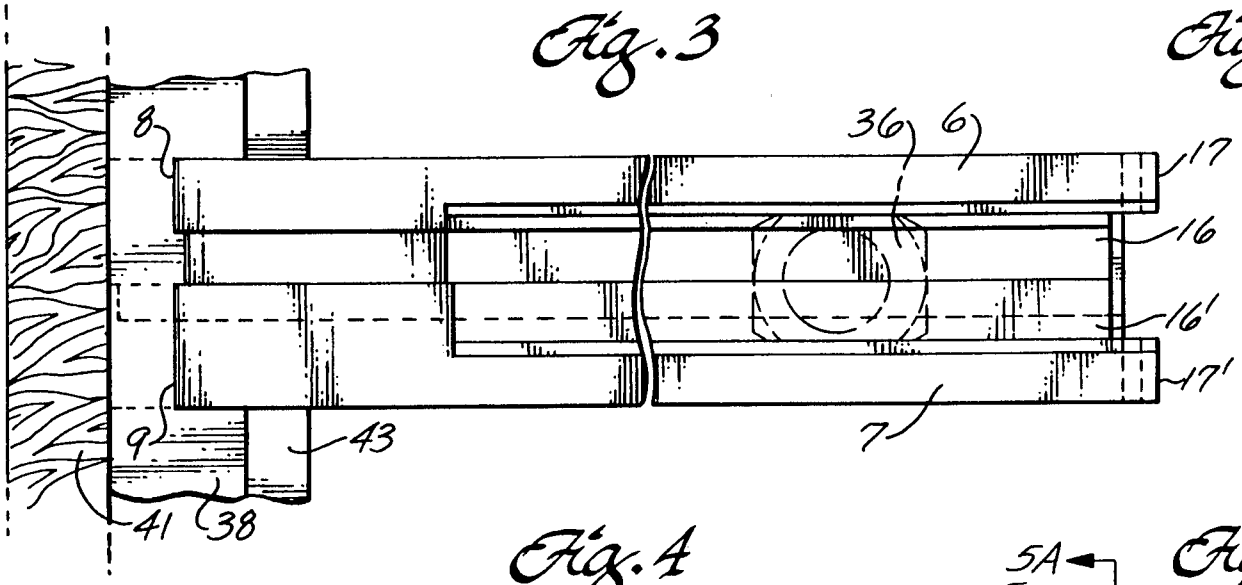
FIG. 3 is a top view of the apparatus as shown in FIG. 1A.
Figure 4:
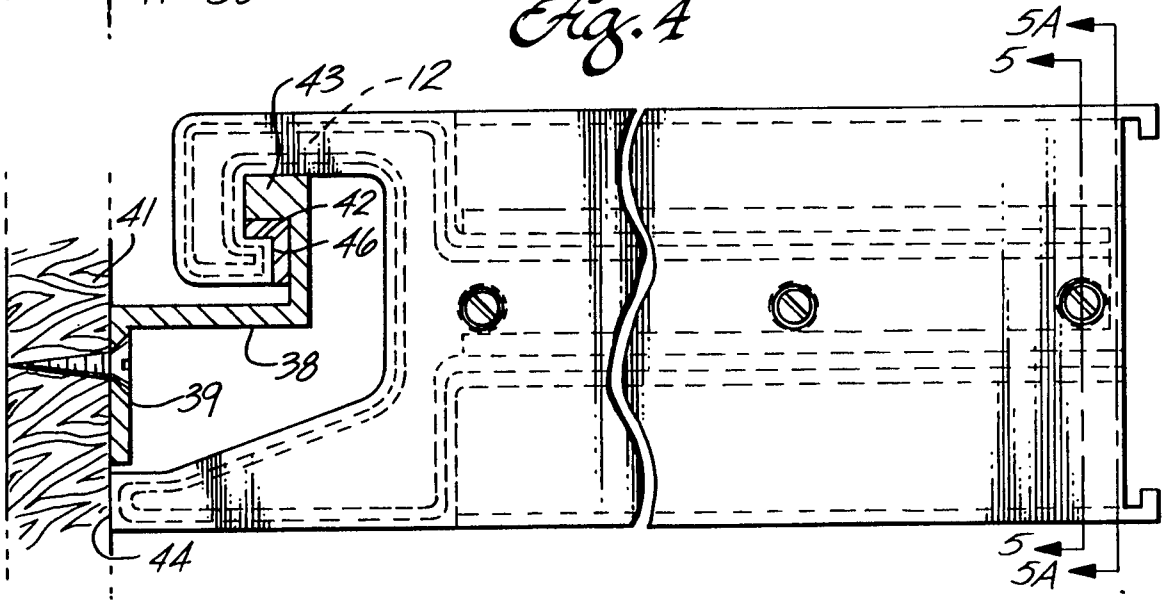
FIG. 4 is a side view of FIG. 3.

By referring to FIG. 5 which is a cross-section taken along the line of 5—5 of FIG. 4, it can be seen that in the assembly of the display device middle flanges 14 and 14' overlap tangentially so as to form a base surface 28 to support reinforcing rib member 29. The reinforcing rib member is a removably replaceable member where the width of the rib member is selectable dependent upon the size of bolt to be carried by the display device. As shown in FIG. 1, reinforcing rib member 29 is U-shaped having a base flange 31 and a nut support flange 32 which are parallel to each other and extend longitudinally from vertical front wall 33. Referring again to FIG. 5, it can be seen that after insertion of reinforcing rib 29 base surface 28 supports base flange 31 of the reinforcing rib member. The upper surface 34 of reinforcing rib member 29 is a planar surface upon which a plurality of nuts may be linearly displayed. Longitudinally extending upper flanges 17 and 17' define the boundary of axially extending upper slot 37 which permits access to the nuts for removal from the display device. Mezzanine flanges 16 and 16' also extend longitudinally and overlap tangentially when the display device is assembled to form a mezzanine surface 35 which is adjacent to support flanges 52 of reinforcment rib member 29 after the rib member is inserted into the display device. In the event the reinforement rib is not utilized in the device, merchandise nuts 36 may be displayed from mezzanine surface 35.

In merchandising the nuts and bolts carried by the display device, it is desirable that the device be mounted at or slightly below eye level. To accomplish this, as shown in FIG. 4, a mounting rail 38 is secured by fastener means 39 to a platform 31 at a selected level which is preferably below the eye level of a consumer of average height. By referring to FIG. 1-A, the assembled first and second side-walls at mounting ends 8 and 9 form a transversely extending shoulder 42 which abutts against upper lip 43 of mounting rail 38. FIG.4 illustrates the use of an optional angled locking piece which is interposed between upper lip 43 and shoulder 42 to account for tolerance variations inherent in the manufacture and assembly of the side-wall members. The assembly of FIG. 1-A also illustrates at mounting ends 8 and 9 of display device 1, bearing surface 44 which bears against platform 41 to support the cantilever mounting of the display device to the mounting rail.

Figure 6:
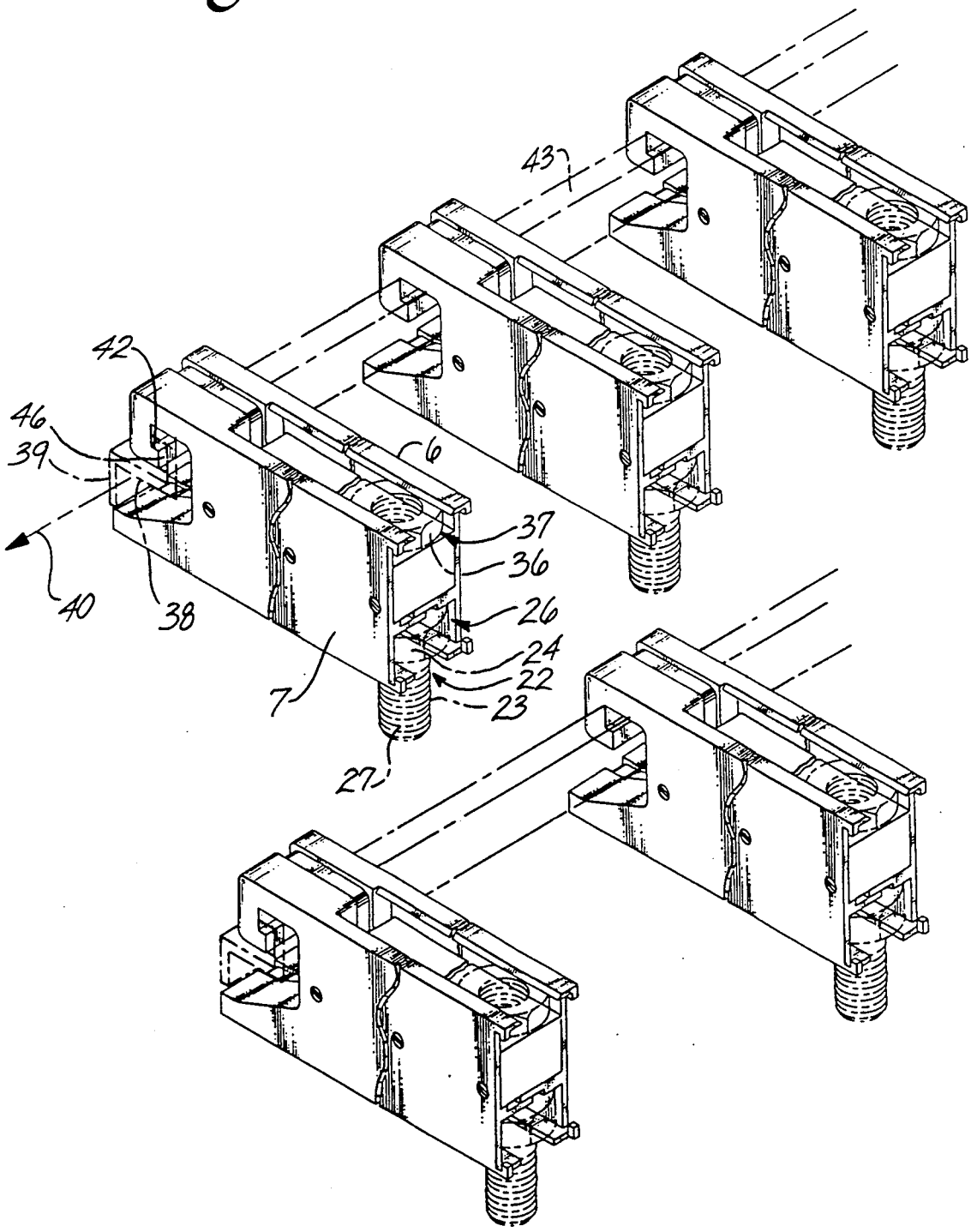
FIG. 6 is a perspective view of a multiplicity of display devices in cantilever suspension from a rail.

In merchandising or storing the product, therefore, a multiplicity of display devices may be suspended from a mounting rail as illustrated in FIG. 6 which permits the display of nuts and bolts of various sizes in a convenient manner that readily accommodate the consumer or user. The width of the display device may be adjusted by securing bolts 19 or by inserting a reinforcing rib member of preselected width thereby permitting the display device to carry nuts and bolts of a particular dimension.

While I have shown and described certain embodiments of the present display device, it is to be understood that it is subject to many modifications without departing from spirit and scope of the claims as recited herein.

What is claimed is:

1. A cantilever display device for the merchandising or storage of nuts and bolts comprising:

a) a first side-wall member having a longitudinal axis and a mounting end where said mounting end has a laterally inwardly projecting mating surface;

b) a second side-wall member having a longitudinal axis and a mounting end having a receiving slot therein for slideably engaging said laterally projecting mating surface;

c) an axially extending first lower flange member projecting laterally inward from said first side-wall member;

d) an axially extending second lower flange member projecting laterally inward from said second side-wall member in the direction of said first side-wall member such that said lower projecting flange members define a lower longitudinally extending slot;

e) means for connecting said first side-wall member to said second side-wall member such that the lateral width of said lower slot is adjustable to a preselected dimension thereby permitting the shank of a bolt to extend through said lower slot and the head of said bolt to be supported by said lower flanges;

f) attachment means for attaching said mounting ends to a support platform for cantilever extension therefrom.

2. The cantilever display device recited in claim 1 wherein said first side-wall member and second side-wall member further comprise respectively an axially extending first upper flange member parallel to said first lower flange member projecting laterally inward from said first side-wall member and an axially extending first mezzanine flange member parallel to said first lower flange member and projecting laterally inward from said first side-wall member and an axially extending second upper flange member parallel to said second lower flange member projecting laterally from said second side-wall member and an axially extending second messanine flange member parallel to said second lower flange member and projecting laterally inward from said second side-wall member where said upper flanges define an upper longitudinally extending slot and said mezzanine flanges are adapted for tangential engagement to form a longitudinally extending nut support surface.

3. The cantilever display device recited in claim 2 where said first and second side-wall members further comprise respectively an axially extending middle flange member parallel to said lower flange member and projecting laterally inward from said respective side-wall member where said middle flanges are adapted for tangential engagement to form a longitudinally extending base surface.

4. The cantilever display device recited in claim 3 further comprising a removably mounted reinforcement rib member of pre-selected width bearing against said base surface for selectively controlling the width of said lower slot.

5. The cantilever display device recited in claim 4 wherein said means for connecting said first side-wall member and said second side-wall member comprises a plurality of internally threaded receptacles projecting laterally inward from said first side-wall member, said second side-wall member having a plurality of aperatures laterally spaced and opposite from said plurality of internally threaded receptacles, and a plurality of securing bolts for threaded engagement with said internally threaded receptacles such that the width of said lower slot may be adjusted by selectively tightening said securing bolts.

* * * * *